US008251507B2

(12) United States Patent
Sugimoto et al.

(10) Patent No.: US 8,251,507 B2
(45) Date of Patent: Aug. 28, 2012

(54) INKJET RECORDING APPARATUS

(75) Inventors: Kiyoshi Sugimoto, Kuwana (JP); Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 693 days.

(21) Appl. No.: 12/361,518

(22) Filed: Jan. 28, 2009

(65) Prior Publication Data

US 2009/0189966 A1 Jul. 30, 2009

(30) Foreign Application Priority Data

Jan. 28, 2008 (JP) ..... 2008-015784

(51) Int. Cl.
*B41J 29/13* (2006.01)
*B41J 2/01* (2006.01)

(52) U.S. Cl. ..... 347/108; 347/104

(58) Field of Classification Search ..... 347/101, 347/104, 108, 84, 85, 66
See application file for complete search history.

(56) References Cited

U.S. PATENT DOCUMENTS

| | | | | |
|---|---|---|---|---|
| 5,274,399 | A | 12/1993 | Uchida et al. | |
| 6,174,045 | B1 * | 1/2001 | Kerr et al. | 347/43 |
| 6,764,174 | B2 * | 7/2004 | Sekiya | 347/102 |
| 7,213,909 | B2 * | 5/2007 | Sekiya | 347/66 |
| 2002/0024541 | A1 * | 2/2002 | Imaizumi et al. | 347/3 |
| 2002/0024575 | A1 * | 2/2002 | Sato | 347/104 |
| 2003/0184622 | A1 | 10/2003 | Sasaki et al. | |
| 2003/0184623 | A1 | 10/2003 | Sasaki et al. | |
| 2004/0086310 | A1 * | 5/2004 | Eskey | 399/401 |
| 2005/0232672 | A1 * | 10/2005 | Nakamura et al. | 399/405 |
| 2006/0038870 | A1 * | 2/2006 | Nonaka | 347/104 |
| 2006/0215008 | A1 * | 9/2006 | Kibayashi | 347/104 |
| 2007/0139506 | A1 * | 6/2007 | Yonekawa | 347/108 |
| 2008/0186355 | A1 | 8/2008 | Sekiya | |

FOREIGN PATENT DOCUMENTS

| | | | | |
|---|---|---|---|---|
| JP | H05-246557 | A | | 9/1993 |
| JP | 2003-182113 | A | | 7/2003 |
| JP | 2004-066490 | A | | 3/2004 |
| JP | 2005-193661 | A | | 7/2005 |
| JP | 2005177989 | A | * | 7/2005 |
| JP | 2006-027159 | A | | 2/2006 |
| JP | 2008-225061 | A | | 8/2006 |
| JP | 2006-264934 | A | | 10/2006 |
| JP | 2007-091398 | A | | 4/2007 |

OTHER PUBLICATIONS

The State Intellectual Property Office of the People's Republic of China; Notification of First Office Action in Chinese Patent Application No. 2009-10003770.0 (counterpart to the above US application) mailed May 19, 2010.

Japan Patent Office, Notice of Reasons for Rejection for Japanese Patent Application No. 2008-015784 (counterpart to above-captioned patent application), mailed Nov. 15, 2011.

* cited by examiner

*Primary Examiner* — Stephen Meier
*Assistant Examiner* — Leonard S Liang
(74) *Attorney, Agent, or Firm* — Baker Botts L.L.P.

(57) ABSTRACT

An inkjet recording apparatus includes: an ink ejection head having ink ejection openings; a conveyance mechanism which is disposed below the ink ejection head and conveys a recording medium facing the ink ejection openings; a recording medium feeder which is disposed below the conveyance mechanism, is capable of stocking therein a recording medium, and feeds a recording medium to the conveyance mechanism; a refeeder which is partially disposed below the recording medium feeder and which refeeds, to the conveyance mechanism, a recording medium having conveyed by the conveyance mechanism; and an ink reservoir which is disposed below the refeeder and reserves therein ink to be fed to the ink ejection head.

6 Claims, 4 Drawing Sheets main scanning direction

⊗——→ sub scanning direction

INKJET RECORDING APPARATUS

The present application claims priority from Japanese Patent Application No. 2008-015784, which was filed on Jan. 28, 2008, the disclosure of which is herein incorporated by reference in its entirety.

BACKGROUND OF THE INVENTION

1 Field of the Invention

The present invention relates to an inkjet recording apparatus which ejects ink.

2 Description of Related Art

Japanese Unexamined Patent Publication No. 2003-182113 (Tokukai 182113/2003) discloses a color inkjet copier including: a recording unit which conducts recording on a sheet which is a recording medium; a conveyor which is disposed below the recording unit and conveys a sheet; a paper feeder which is disposed below the conveyor and feeds a sheet to the conveyor; and ink containers which are disposed below the paper feeder. This color inkjet copier is configured to conduct recording on only one surface of a sheet.

SUMMARY OF THE INVENTION

In order to conduct recording on both surfaces of a sheet using the color inkjet copier of this publication, it is necessary to provide a refeed path for turning over a sheet that has received recording on one surface thereof and refeeding the sheet to the feeder. However, in the case where the refeed path is provided between the conveyor and the paper feeder in this color inkjet copier, a sheet has to be turned over in the refeed path at a small radius of curvature, which increases the chance of jamming. In the case where the refeed path is provided below the ink containers, if ink leaks from an ink container, the leaking ink soils the refeed path and is transferred to a sheet conveyed on the refeed path. As a result, the sheet is soiled.

An object of the present invention is to provide an inkjet recording apparatus capable of decreasing the chance of jamming and capable of preventing a recording medium from being soiled even if ink leakage occurs.

An inkjet recording apparatus of the present invention includes: an ink ejection head having ink ejection openings; a conveyance mechanism which is disposed below the ink ejection head and conveys a recording medium facing the ink ejection openings; a recording medium feeder which is disposed below the conveyance mechanism, is capable of stocking therein a recording medium, and feeds a recording medium to the conveyance mechanism; a refeeder which is partially disposed below the recording medium feeder and which refeeds, to the conveyance mechanism, a recording medium having conveyed by the conveyance mechanism; and an ink reservoir which is disposed below the refeeder and reserves therein ink to be fed to the ink ejection head.

In the structure of the inkjet recording apparatus of the present invention, the ink reservoir is disposed below the refeeder. Therefore, even if the ink leaks from the ink reservoir, it is possible to prevent the leaking ink from soiling a recording medium in the refeeder. In addition, the refeeder is disposed not above the recording medium feeder, but below the recording medium feeder. This arrangement increases the radius of curvature of a recording medium turned over in the refeeder, and thereby decreases the chance of jamming.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
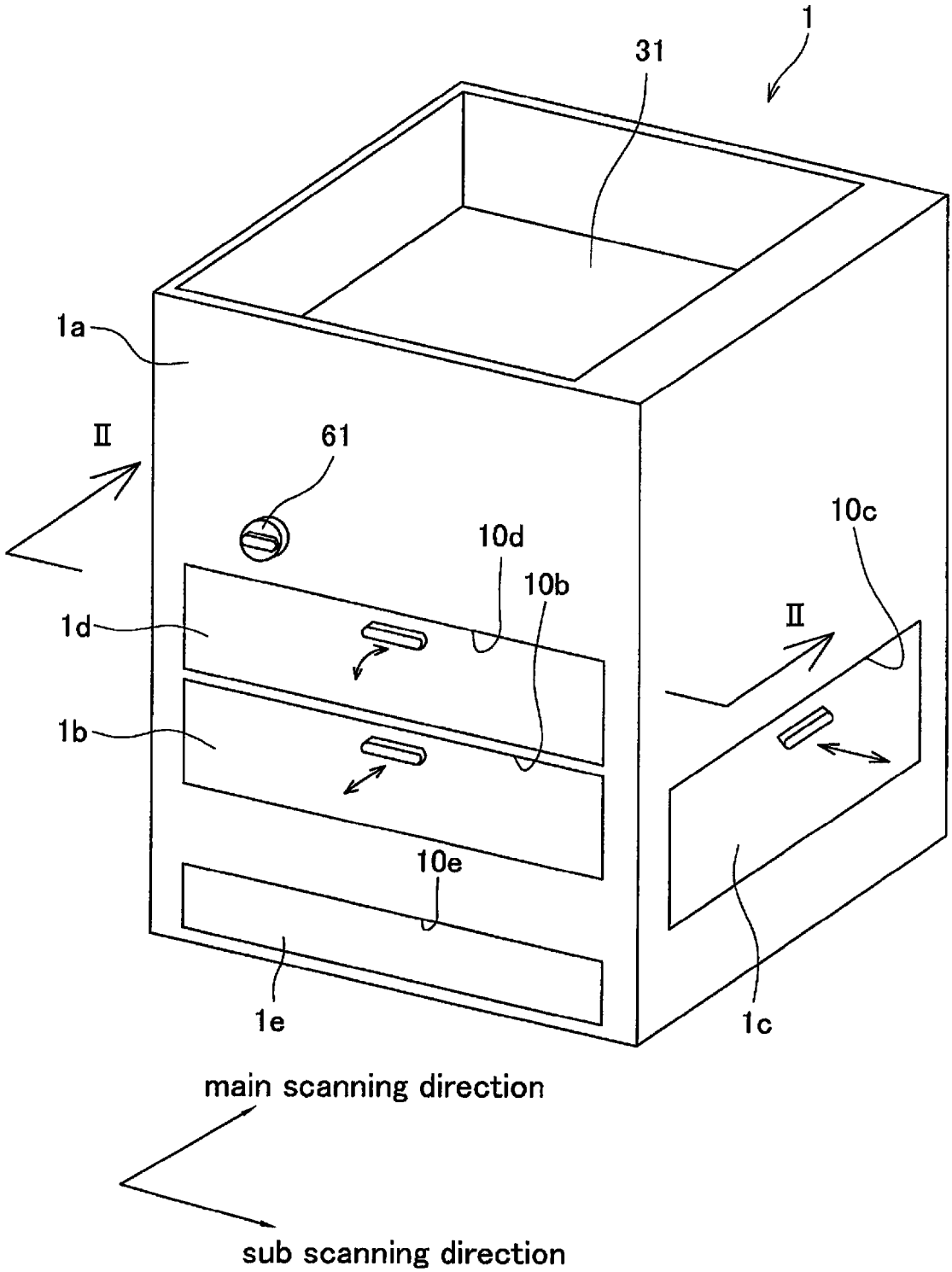
FIG. 1 is a perspective view illustrating an external appearance of an ink-jet printer of an embodiment of the present invention.
Figure 2:
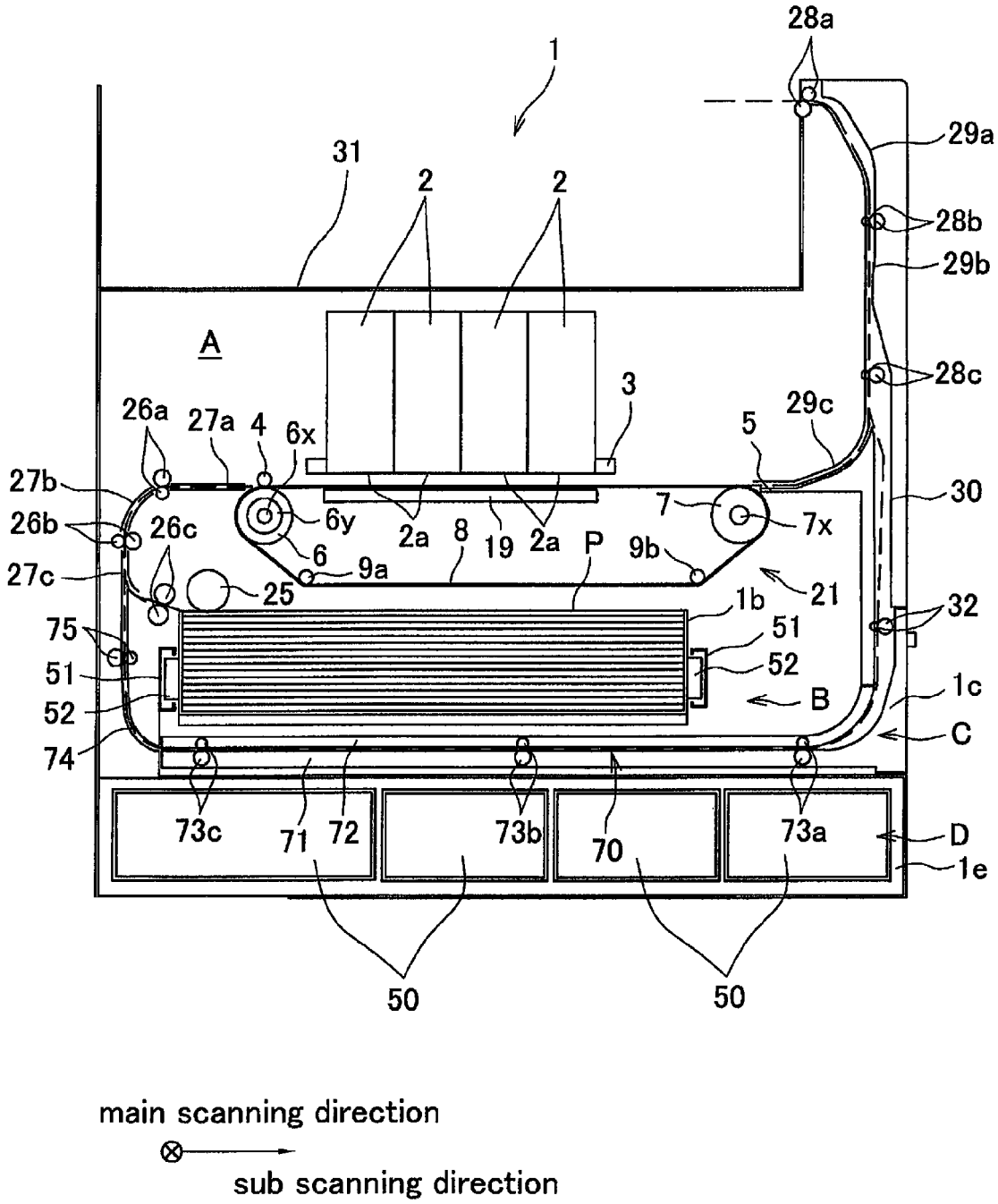
FIG. 2 is a cross-sectional side view of the ink-jet printer viewed along the direction of arrows II in FIG. 1.

The following describes a preferred embodiment of the present invention, with reference to attached drawings. This embodiment deals with an application of the present invention to an inkjet printer which records text, images, or the like on a recording sheet by ejecting ink. FIG. 1 is a perspective view illustrating an external appearance of the ink-jet printer of the embodiment of the present invention. FIG. 2 is a cross-sectional side view of the ink-jet printer viewed along the direction of arrows II in FIG. 1.

As shown in FIG. 1, an ink-jet printer 1 (inkjet recording apparatus) has a housing 1*a* of a rectangular parallelepiped shape. The ink-jet printer 1 has, on its front surface (a surface close to a viewer in FIG. 1), from the top: a rotating member 61 which is rotated by a user; an opening 10*d*; a door 1*d* which is fitted to the opening 10*d* and is openable and closable about a horizontal shaft located at its lower end; an opening 10*b* through which a paper feed cassette 1*b* (recording medium feeder) is inserted into the ink-jet printer 1; and an opening 10*e* through which an ink tank cassette 1*e* is inserted into the ink-jet printer 1. The ink-jet printer 1 has, on the right side surface thereof, an opening 10*c* through which a refeed cassette 1*c* is inserted into the ink-jet printer 1. Further, the ink-jet printer 1 includes a paper discharger 31 on its upper surface. The door 1*d* is disposed so as to face a later mentioned conveyance unit 21 with respect to a main scanning direction of the housing 1*a*, that is, a direction perpendicular to a plane of FIG. 2.

Next, the internal structure of the ink-jet printer 1 will be described with reference to FIG. 2. As shown in FIG. 2, in the housing 1*a*, the ink-jet printer 1 has, from the top: four ink-jet heads 2 (ink ejection head), the conveyance unit 21, the paper feed cassette 1*b*, the refeed cassette 1*c*, and the ink tank cassette 1*e*. The inside of the housing 1*a* of the ink-jet printer 1 is divided into four spaces A, B, C, and D, from the top.

In the space A, there are disposed: the four ink-jet heads 2 which respectively eject inks of magenta, cyan, yellow, and black, and each of which has a plurality of nozzles 2*a* (ink ejection openings); and the conveyance unit 21 which conveys a sheet P so that the sheet P faces the nozzles 2*a*.

In the space B, the paper feed cassette 1*b* is disposed. The paper feed cassette 1*b* is detachable from the housing 1*a*, and is configured to send one sheet P after another to the conveyance unit 21 so that one surface of the sheet P faces the nozzles 2*a*. The space B communicates with the opening 10*b*. The paper feed cassette 1*b* is detached from the housing 1*a* in the main scanning direction.

In the space C, the refeed cassette 1*c* is disposed. The refeed cassette 1*c* is detachable from the housing 1*a*, and is configured to turn over the sheet P that has been conveyed by the conveyance unit 21, so that the other surface of the sheet P faces the nozzles 2*a*, and then to refeed the sheet P to the conveyance unit 21. The space C communicates with the opening 10*c*. The refeed cassette 1*c* is detached from the housing 1*a* in a sub scanning direction perpendicular to the main scanning direction, that is, in the direction from the left to right in FIG. 2.

In the space D, the ink tank cassette 1*e* is disposed. The ink tank cassette 1*e* has four ink tanks 50 (ink reservoir) which reserve inks therein to be fed to the four ink-jet heads 2, respectively. The space D communicates with the opening 10*e*. The ink tank cassette 1*e* is detached from the housing 1*a* in the main scanning direction.

In short, in the housing 1*a*, the conveyance unit 21 is disposed below the four ink-jet heads 2; the paper feed cassette 1*b* is disposed below the conveyance unit 21; the refeed cassette 1*c* is disposed below the paper feed cassette 1*b*; and the four ink tanks 50 are disposed below the refeed cassette 1*c*.

The ink-jet printer 1 has a sheet conveyance path formed therein, along which a sheet P (recording medium) is conveyed from the paper feed cassette 1*b* to the paper discharger 31. The paper feed cassette 1*b* is capable of stocking therein a stack of sheets P. The sheets P stocked in the paper feed cassette 1*b* are picked up by a pickup roller 25 one by one from a top-most sheet P. A picked sheet P is sent, while being guided by guides 27*a*, 27*b*, and 27*c* and gripped by pairs of rollers 26*a*, 26*b*, and 26*c*, to the conveyance unit 21 so that one surface of the sheet P faces the nozzles 2*a*.

The pickup roller 25 is mounted on the paper feed cassette 1*b*. The paper feed cassette 1*b* has, at both ends thereof in the sub scanning direction, slide members 52 respectively, which are slidable relative to the respective supports 51 each fixed to the housing 1*a*. In other words, the paper feed cassette 1*b* can be moved in the main scanning direction by sliding the slide members 52 along the respective supports 51.

The conveyance unit 21 has: two belt rollers 6 and 7; an endless conveyor belt 8 looped around the rollers 6 and 7; and tension rollers 9*a* and 9*b*. The tension rollers 9*a* and 9*b* each contacts the internal surface of the lower loop of the conveyor belt 8 and exerts a downward force onto the conveyor belt 8, thereby applying tension to the conveyor belt 8. The belt roller 7 is a drive roller and rotates clockwise in FIG. 2 driven by a not-shown conveyance motor fixed to a shaft 7*x* of the belt roller 7. The belt roller 6 is a driven roller and rotates clockwise in FIG. 2 as the conveyor belt 8 travels due to the rotation of the belt roller 7.

As described later, the driven belt roller 6 is movable downward to: the space B emptied due to the detachment of the paper feed cassette 1*b* from the housing 1*a*; and the space C emptied due to the detachment of the refeed cassette 1*c* from the housing 1*a*. That is, the space B is a space for receiving the paper feed cassette 1*b*, and also a space in which a part of the conveyance unit 21 is positioned when the belt roller 6 moves downward. In addition, the space C is a space for receiving the refeed cassette 1*c*, and also a space in which a part of the conveyance unit 21 is positioned when the belt roller 6 moves downward.

The external surface of the conveyor belt 8 has been treated with silicone to achieve adhesiveness. A nip roller 4 is disposed in the sheet conveyance path so as to face the belt roller 6 with the conveyor belt 8 interposed therebetween. The nip roller 4 presses down the sheet P sent from the paper feed cassette 1*b* onto the external surface of the conveyor belt 8. The sheet P pressed onto the external surface of the conveyor belt 8 is conveyed to the right, while being held on the external surface by the adhesiveness of the external surface.

Also in the sheet conveyance path, a peel plate 5 is provided so as to face the belt roller 7 with the conveyor belt 8 interposed therebetween. The peel plate 5 peels, from the external surface, the sheet P held by the external surface of the conveyor belt 8. The sheet P peeled by the peel plate 5 from the external surface of the conveyor belt 8 is sent upward while being guided by guides 29*a*, 29*b*, and 29*c* and gripped by pairs of rollers 28*a*, 28*b*, and 28*c*, and then discharged to the paper discharger 31 through an opening 30 formed in an upper part of the housing 1*a*.

In the meantime, one roller of each pair of rollers 28*a*, 28*b*, 28*c* is a switchback roller which is rotatable in a direction opposite to the rotation direction for sending and discharging a sheet P from the conveyor belt 8 to the paper discharger 31. Therefore, the sheet P peeled by the peel plate 5 from the external surface of the conveyor belt 8 is first sent upward while being guided by the guides 29*a*, 29*b*, and 29*c* and gripped by the pairs of rollers 28*a*, 28*b*, and 28*c*; and then sent to the refeed cassette 1*c* below, while being guided by a guide 30 and gripped by a pair of rollers 32, by rotation of the pairs of rollers 28*a*, 28*b*, and 28*c* in the opposite direction.

The refeed cassette 1*c* has: a lower guide 71; an upper guide 72; and pairs of rollers 73*a*, 73*b*, and 73*c*. The lower guide 71 is formed of, in the cross section, a portion extending in a vertical direction, i.e., an up and down direction in FIG. 2; a portion extending in the main scanning direction; and a curved portion between these portions. There is a predetermined gap between the upper guide 72 and the lower guide 71, which gap forms a refeed path 70 for a sheet P. The sheet P sent downward while being guided by the guide 30 and gripped by the pair of rollers 32 is sent in a direction opposite to a conveyance direction of a sheet P conveyed by the conveyor belt 8, while being guided by the upper guide 72 and the lower guide 71 and gripped by the pairs of rollers 73*a*, 73*b*, and 73*c*. At this time, skew of the sheet P is corrected by a not-shown skew correction roller.

Then, while being guided by the guides 27*a*, 27*b*, and 27*c* and a guide 74, and gripped by the pairs of rollers 26*a* and 26*b* and a pair of rollers 75, the sheet P is sent to the conveyance unit 21 so that the other surface of the sheet P faces the nozzles 2*a*. That is, one surface of a sheet P faces the nozzles 2*a* when the sheet P is conveyed from the paper feed cassette 1*b* to the conveyance unit 21, and then the back surface of the sheet P faces the nozzles 2*a* when the sheet P is conveyed from the refeed path 70 to the conveyance unit 21. As a result, the sheet P receives printing on both surfaces thereof. Note that the refeed path 70 is constituted by: the guide 30; the upper guide 72; the lower guide 71; and the guides 27*a*, 27*b*, 27*c*, and 74. The guides 27*a*, 27*b*, 27*c*, and 74 forms a u-turn path for reversing the traveling direction of the sheet P.

Figure 3:
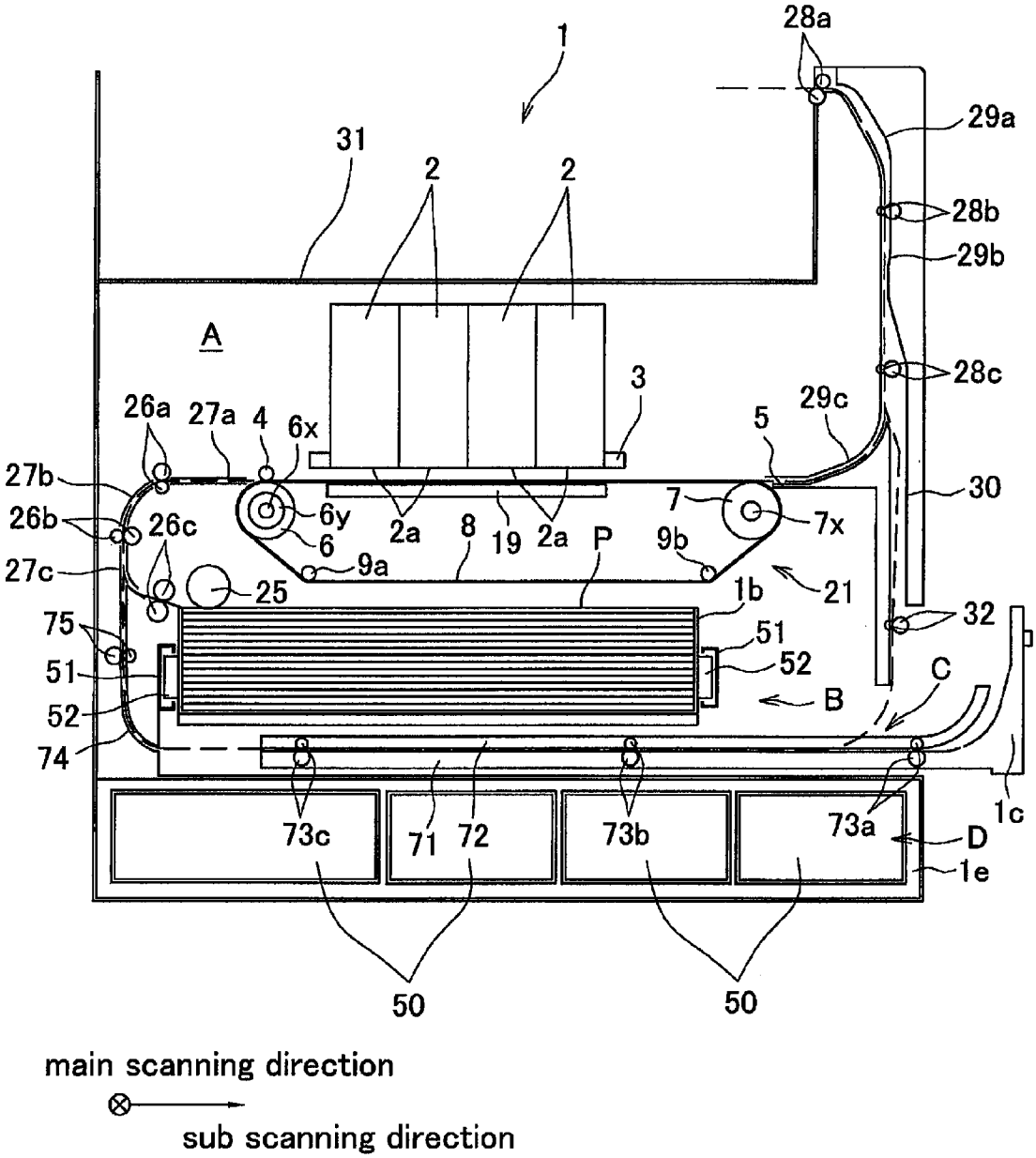
FIG. 3 is across-sectional side view of the ink-jet printer with a refeed cassette moved toward the outside of a housing.

As shown in FIG. 3, the refeed cassette 1*c* is detachable from the housing 1*a* in the conveyance direction of a sheet P conveyed by the conveyor belt 8 (in the sub scanning direction). Assuming that the detaching direction of the refeed cassette 1*c* is a direction perpendicular to the conveyance direction, i.e., the main scanning direction, a sheet P partially remaining in the refeed cassette 1*c* tears when the refeed cassette 1*c* is pulled out from the housing 1*a*. However, since the detaching direction of the refeed cassette 1*c* corresponds to the conveyance direction (sub scanning direction), it is possible to easily find a sheet P remaining in the housing 1*a* when the refeed cassette 1*c* is pulled out from the housing 1*a*, and therefore to easily clear jam from the refeed path 70.

The four ink-jet heads 2 each extending in the main scanning direction are aligned in the sub scanning direction and supported by the housing 1*a* via a frame 3. That is, the ink-jet printer 1 is a line-type color ink-jet printer capable of conducting printing on both surfaces of a sheet P. On the under surface of each ink-jet head 2, a plurality of nozzles 2*a* are formed.

In the loop of the conveyor belt 8, a platen 19 having a nearly rectangular-parallelepiped shape is disposed so as to face the four ink-jet heads 2. The upper surface of the platen 19 contacts the internal surface of the upper loop of the conveyor belt 8, and supports the conveyor belt 8 from the inner periphery of the conveyor belt 8. With this, the external surface of the upper loop of the conveyor belt 8 is facing and parallel to the under surfaces of the ink-jet heads 2, i.e., the nozzles 2*a*; and a small gap is created between the nozzles 2*a* and the external surface of the conveyor belt 8. This gap constitutes a part of the sheet conveyance path. When a sheet P held on and conveyed by the external surface of the conveyor belt 8 passes immediately under the four ink-jet heads 2 sequentially, different colors of ink are respectively ejected onto an upper surface of the sheet P, thereby producing a desired color image on the sheet P.

The ink-jet heads 2 are respectively connected to the ink tanks 50 in the ink tank cassette 1*e* disposed at a lower part of the housing 1*a*. In other words, the four ink tanks 50 respectively reserve therein different colors of ink corresponding to the respective ink-jet heads 2, and the ink is supplied from each ink tank 50 to the associated ink-jet head 2 via a not-shown tube or the like. Each of the four ink tanks 50 extends in the main scanning direction, and has a length in the sub scanning direction longer than that in the vertical direction. The four ink tanks 50 entirely overlap one another when the ink tanks 50 are projected onto a vertical plane in a horizontal direction. This makes it possible to shorten the length of the printer 1 in the vertical direction, thereby to downsize the printer 1 in the vertical direction.

Figure 4A:
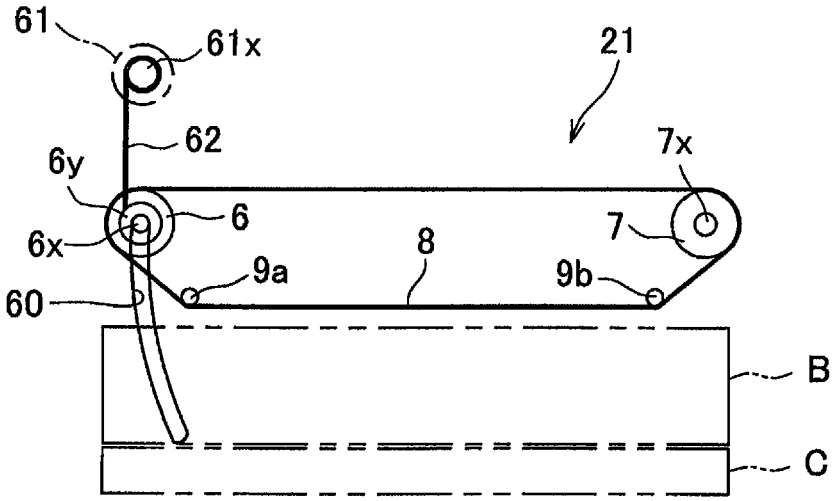
FIGS. 4A, 4B, and 4C are schematic views for explanation of movement of a belt roller.
Figure 4B:
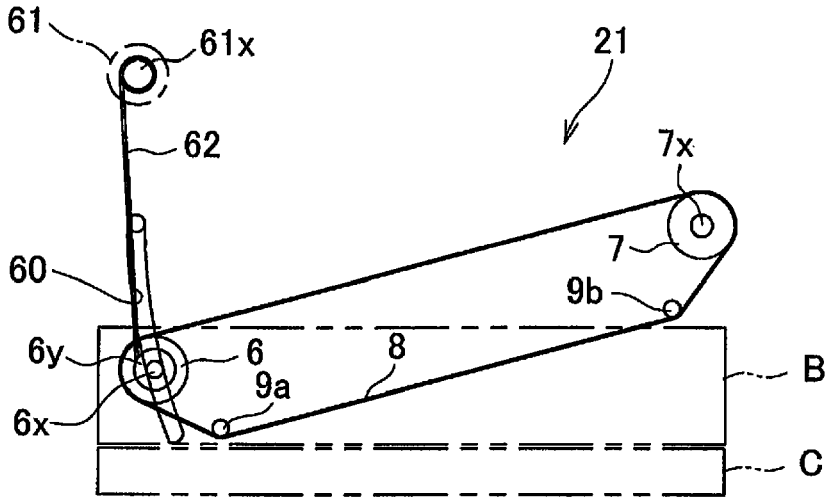
Figure 4C:
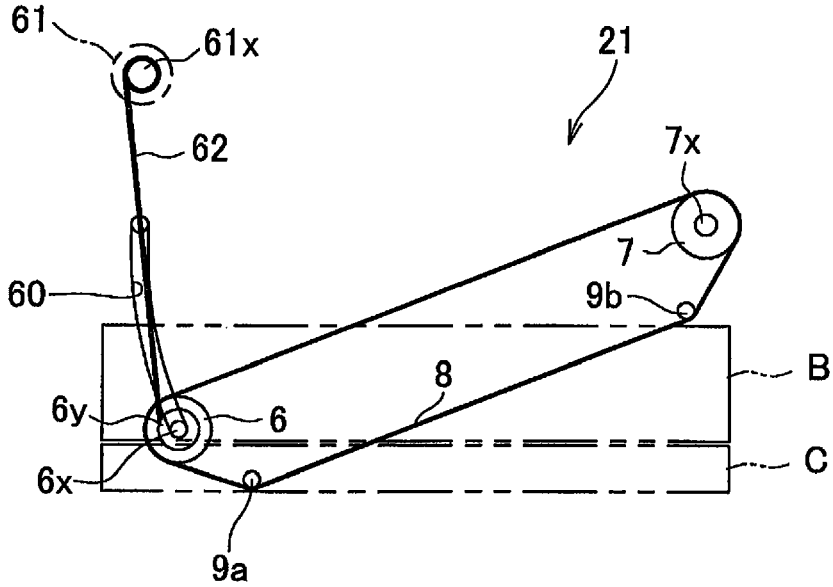

The following describes movement of the belt roller 6, with reference to FIGS. 4A, 4B, and 4C. These figures are schematic views for explanation of the movement of the belt roller.

At both ends of the belt roller 6 in its axial direction, rods 6*x* are respectively fixed so that the rods 6*x* axially protrude from the respective ends. The rods 6*x* respectively penetrate slits 60 each formed in a printer main body. Each slit 60 is a long narrow opening having: an upper end leveled with a corresponding rod 6*x* being in normal printing operation shown in FIG. 2; and a lower end positioned in the vicinity of the boundary between the space B and the space C. From the upper end to the lower end, the slit extends, obliquely downward to the right, in an arc about the shaft 7*x* of the belt roller 7. FIGS. 4A, 4B, and 4C each illustrates one of the rods 6*x* of the belt roller 6, which rod 6*x* is inserted through the associated slit 60. At one end of the belt roller 6, a stepped portion 6*y* having a larger diameter than that of the rod 6*x* is formed in such a manner that the stepped portion 6*y* is interposed between the one end and the rod 6*x*. To the outer periphery of the stepped portion 6*y*, one end of a connection member 62 such as wire is fixed. The other end of the connection member 62 is fixed to and wound around a shaft 61*x* of the rotating member 61. In a state shown in FIG. 4A, that is, during the normal printing operation, torque is applied clockwise to the shaft 61*x* of the rotating member 61, using a gear, clutch spring or the like, to prevent the connection member 62 from being unwound.

When clearing a jammed sheet P, a user of the printer 1 first pulls out the paper feed cassette 1*b* in the direction toward a viewer in FIG. 1, and detaches the paper feed cassette 1*b* from the housing 1*a*. This empties the space B (see FIG. 2).

Then, as the rotating member 61 is rotated counterclockwise in FIG. 4A, the connection member 62 is unwounded from the shaft 61*x*. Along with this, the distance between the shaft 61*x* and the stepped portion 6*y* in the connection member 62 becomes longer, and the rod 6*x* slides along the associated slit 60, obliquely downward to the right, in an arc about the shaft 7*x* of the belt roller 7, and then stops at a certain point of the slit 60 in the space B before reaching the lower end, as shown in FIG. 4B.

As the rod 6*x* moves in this manner, the belt roller 6 also moves obliquely downward to the right, in an arc about the shaft 7*x* of the belt roller 7. This causes a part of the conveyance unit 21, i.e., a part of the belt roller 6 and a part of the conveyor belt 8 to be positioned in the space B. In other words, the conveyance unit 21 at this time is positioned across the boundary between the space A and the space B. Although the belt roller 7 is always at a fixed position, the tension rollers 9*a* and 9*b* move, when the belt roller 6 moves, in a same manner as the belt roller 6, that is, move in an arc about the shaft 7*x* of the belt roller 7, in order to keep the shape of the conveyor belt 8 always constant by continuously applying constant tension to the conveyor belt 8. In addition, during the movement of the belt roller 6, torque is applied clockwise to the shaft 61*x* of the rotating member 61 using a gear, clutch spring or the like, to prevent the belt roller 6 from moving at excessively fast speed. In this manner, the slit 60, the rotating member 61, and the connection member 62 constitute the movement mechanism.

The movement of the belt roller 6 from the position shown in FIG. 4A to that in FIG. 4B increases the distance between the conveyor belt 8 and the ink-jet heads 2. Therefore, a sheet P jammed in the course of conveyance between the upper loop of the conveyor belt 8 and the heads 2 is easily found and removed from the housing 1*a* when opening the door 1*d* (see FIG. 1) by pulling, toward a user, the door 1*d* provided on the front surface of the housing 1*a*. Furthermore, utilizing the space B, in which the paper feed cassette 1*b* is disposed, eliminates the need for a space only for moving the conveyance unit 21 thereto. Accordingly, it is possible to downsize the printer 1.

In the case where it is still difficult to clear a jammed sheet P even though the distance between the conveyor belt 8 and the ink-jet heads 2 is increased, the user of the printer 1 pulls out the refeed cassette 1*c* to the right in FIG. 1 and detaches the refeed cassette 1*c* from the housing 1*a*. This empties the space C (see FIG. 2).

Then, as the rotating member 61 is rotated counterclockwise in FIG. 4B, the connection member 62 is unwound from the shaft 61*x*. Along with this, the rod 6*x* moves and then stops at the lower end of the slit 60 positioned in the vicinity of the boundary between the space B and the space C, as illustrated in FIG. 4C. With this movement of the rod 6*x*, the belt roller 6 also moves obliquely downward to the right, in an arc about the shaft 7*x* of the belt roller 7. As a result, a part of the conveyance unit 21, i.e., a part of the belt roller 6 and a part of the conveyor belt 8 is positioned in the space C. In other words, the conveyance unit 21 at this time is positioned across the boundary between the space A and the space B and the boundary between the space B and the space C. Although the belt roller 7 is at the fixed position, the tension rollers 9*a* and 9*b* move, when the belt roller 6 moves, in a same manner as the belt roller 6, that is, move in an arc about the shaft 7*x* of the belt roller 7, in order to keep the shape of the conveyor belt 8 always constant by continuously applying constant tension to the conveyor belt 8.

Thus, a space for moving the conveyance unit 21 thereto is enlarged by utilizing the space C for the refeed cassette 1*c* to be disposed therein, in addition to the space B for the paper feed cassette 1*b* to be disposed therein. The movement of the belt roller 6 from the position shown in FIG. 4B to that in FIG. 4C further increases the distance between the conveyor belt 8 and the ink-jet heads 2. Therefore, it is much easier to find a sheet P jammed in the course of conveyance between the upper loop of the conveyor belt 8 and the heads 2 and remove the sheet P from the housing 1*a*.

After the jam is cleared in this way, the opened door 1*d* is closed, and then the rotating member 61 is rotated clockwise in FIG. 4C. This causes the connection member 62 to be wound around the shaft 61*x*, and decreases the distance between the shaft 61*x* and the stepped portion 6*y* in the connection member 62. In addition, the rod 6*x* slides along the associated slit 60 obliquely upward to the left in an arc about the shaft 7*x* of the belt roller 7, and stops at the upper end of the slit 60 shown in FIG. 4A. With this movement of the rod 6*x*, the belt roller 6 also moves obliquely upward to the left in an arc about the shaft 7*x* of the belt roller 7 to return to an original position shown in FIG. 4A, that is, the position for normal printing operation. Then, the paper feed cassette 1*b* is re-attached to the housing 1*a* to be disposed in the space B, and the refeed cassette 1*c* is re-attached to the housing 1*a* to be disposed in the space C. Now the printer 1 is ready for printing. Accordingly, upon receiving a command to resume printing from a personal computer or the like, a top-most sheet P is picked up out of a stack in the paper feed cassette 1*b*, and printing is conducted.

As described above, in the structure of the ink-jet printer 1 of this embodiment, the ink tanks 50 are disposed below the refeed cassette 1*c* in the housing 1*a*. Therefore, even if ink leaks from an ink tank 50, it is possible to prevent the leaking ink from soiling a sheet P in the refeed cassette 1*c*. In addition, the refeed cassette 1*c* is disposed not above the paper feed cassette 1*b*, but disposed below the paper feed cassette 1*b*. This arrangement increases the radius of curvature of a sheet P turned over in the refeed path 70, and thereby decreases the chance of jamming.

A preferred embodiment of the present invention has been described above. However, the present invention should not be narrowly interpreted within the limits of such embodiment, but rather may be applied in many variations within the scope of the claims.

At a time of clearing jam in the above-described embodiment, a user pulls out the paper feed cassette 1*b* to detach the paper feed cassette 1*b* from the housing 1*a*, and then operates the rotating member 61, so that the belt roller 6 is moved. In short, the belt roller 6 is moved by the user's operation. However, the belt roller 6 may be moved automatically by way of control by a controller of the printer 1, without the user's operation. The following example deals with a case where the printer 1 is provided with: a sensor which detects jam of a sheet P; a sensor which detects that the paper feed cassette 1*b* is detached; and a motor which drives the rotating member 61. First, in response to detection of jam of a sheet P by the sensor, the controller notifies a user that jam occurs and provides a direction to pull out the paper feed cassette 1*b*. When the user pulls out the paper feed cassette 1*b*, the sensor detects that the paper feed cassette 1*b* is detached. Based on this detection, the controller controls the motor so as to move the belt roller 6 to the space B, which is the space for receiving the paper feed cassette 1*b* therein. After the belt roller 6 is moved, the controller provides the user with a direction to remove the sheet P. The user who has seen the direction opens the door 1*d* to remove the jammed sheet P from the housing 1*a*, and then closes the door 1*d*. Then, based on the detection that the jam of the sheet P has been cleared, the controller controls the motor so as to return the belt roller 6 to its original position. Then, the controller provides the user with a direction to attach the paper feed cassette 1*b*. After the paper feed cassette 1*b* is re-attached to the housing 1*a*, the controller resumes printing based on the detection by the sensor of the attachment of the paper feed cassette 1*b*. Note that, the detachment/attachment of the paper feed cassette 1*b* from/to the housing 1*a* may also be controlled by the controller, instead of the operation by the user, by providing appropriate mechanisms. Other various methods may be used to move the belt roller 6.

The rotating member 61 does not necessarily have to be provided on the same surface of the housing 1*a* as the surface having thereon the door 1*d* and/or the opening 10*d*.

In the above-described embodiment, the rotating member 61, the connection member 62, and the like are provided as a movement mechanism. However, the movement mechanism is not limited to this structure. The movement of the belt roller 6 may be realized using other various mechanisms.

In the above-described embodiment, only the driven belt roller 6 is moved with the driving belt roller 7 fixed. However, contrary to the above embodiment, it is possible to move the belt roller 7 only, with the belt roller 6 fixed, for example. Alternatively, the entire conveyance unit 21 may be shifted in parallel by simultaneously moving the belt rollers 6 and 7 downwardly.

In the above-described embodiment, the driven belt roller 6 is moved with the driving belt roller 7 fixed, in order to clear jam. However, for the case of no chance of jamming, a mechanism for moving the belt roller 6 may be omitted.

The detaching direction of the paper feed cassette 1*b* is not limited to the main scanning direction, but may be any directions. Also, the detaching direction of the refeed cassette 1*c* is not limited to the sub scanning direction, but may be any directions. For example, in the case where the detaching direction of the refeed cassette 1*c* is the main scanning direction, that direction is the same as the detaching direction of the paper feed cassette 1*b* and the ink tanks 50. This allows a user to detach these members in the same direction, leading to easy operation. In addition, this diminishes the limitation for installation of the apparatus. For example, walls may be provided near the both ends of the apparatus in the sub scanning direction.

In the above-described embodiment, each of the ink tanks 50 has a length in the sub scanning direction longer than that in the vertical direction. However, either one of these length may be longer than the other length. For example, in the case where there are so many ink tanks, such as ten ink tanks, the length in the vertical direction may be longer than that in the sub scanning direction, in view of space constraint.

In the above-described embodiment, the paper feed cassette 1*b* and the refeed cassette 1*c* are completely pulled out, i.e., detached from the housing 1*a*; however these cassettes may be partially pulled out of the housing 1*a*. For example, each pulled-out cassette may be held by the housing 1*a* just before the rear end of the cassette leaves the housing 1*a*.

In the above-described embodiment, the four ink tanks 50 are aligned in the sub scanning direction; however, the ink tanks 50 may be aligned in the main scanning direction.

The recording apparatus according to the present invention is not limited to an ink-jet recording apparatus, but is applicable to a thermal type recording apparatus. In addition, the application of the present invention is not limited to a line-type recording apparatus but also includes a serial-type recording apparatus having a reciprocating head. Further, the present invention is applicable not only to a printer, but also to a facsimile machine, copier, or the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

an ink ejection head having ink ejection openings;

a conveyance mechanism which is disposed below the ink ejection head and conveys a recording medium facing the ink ejection openings;

a recording medium feeder which is disposed below the conveyance mechanism, is capable of stocking therein a recording medium, and feeds a recording medium to the conveyance mechanism;

a refeeder which is partially disposed below the recording medium feeder and which refeeds, to the conveyance mechanism, a recording medium having conveyed by the conveyance mechanism, along a refeed path which includes a first path and a second path following the first path, the first path passing through a space below the recording medium feeder, and the second path passing in a vertical direction to the conveyance mechanism through a space at a side of the recording medium feeder;

an ink reservoir which is disposed below the refeeder and reserves therein ink to be fed to the ink ejection head;

a housing that houses the ink ejection head, the conveyance mechanism, the recording medium feeder, and the refeeder therein, wherein the refeeder is movable toward the outside of the housing in a conveyance direction of a recording medium conveyed by the conveyance mechanism.

2. The inkjet recording apparatus according to claim 1, wherein a length of the ink reservoir in the conveyance direction is greater than that in the vertical direction.

3. The inkjet recording apparatus according to claim 1 comprising a plurality of the ink reservoirs, wherein the plurality of the ink reservoirs entirely overlap one another when the ink reservoirs are projected onto a vertical plane in a horizontal direction.

4. The inkjet recording apparatus according to claim 1, wherein the refeeder is configured to reverse a traveling direction of a recording medium.

5. An inkjet recording apparatus comprising:

an ink ejection head having ink ejection openings;

a conveyance mechanism which is disposed below the ink ejection head and conveys a recording medium facing the ink ejection openings;

a recording medium feeder which is disposed below the conveyance mechanism, is capable of stocking therein a recording medium, and feeds a recording medium to the conveyance mechanism;

a refeeder which is partially disposed below the recording medium feeder and which refeeds, to the conveyance mechanism, a recording medium having conveyed by the conveyance mechanism, along a refeed path which includes a first path and a second path following the first path, the first passing through a space below the recording medium feeder, and the second path in a vertical direction to the conveyance mechanism through a space at a side of the recording medium feeder;

an ink reservoir which is disposed below the refeeder and reserves therein ink to be fed to the ink ejection head;

a housing that houses the ink ejection head, the conveyance mechanism, the recording medium feeder, and the refeeder, and the ink reservoir therein; and a movement mechanism capable of moving at least a part of the conveyance mechanism downward, wherein the recording medium feeder is movable toward the outside of the housing, and wherein the movement mechanism is capable of, when at least a part of the recording medium feeder is positioned outside the housing, moving at least a part of the conveyance mechanism to a first space which is created by the movement of the recording medium feeder toward the outside of the housing.

6. The inkjet recording apparatus according to claim 5, wherein the refeeder is movable toward the outside of the housing, and wherein the movement mechanism is capable of, when at least a part of the recording medium feeder and at least a part of the refeeder are positioned outside the housing, moving at least a part of the conveyance mechanism to the first space and to a second space which is created by the movement of the refeeder toward the outside of the housing.

* * * * *